US005460915A

United States Patent [19]

Nakanishi et al.

[11] Patent Number: 5,460,915

[45] Date of Patent: Oct. 24, 1995

[54] CHARGE CONTROLLER, TONER BINDER COMPOSITION AND ELECTROPHOTOGRAPHIC TONER

[75] Inventors: Hideo Nakanishi; Tohru Ohama; Hiroyuki Ikeda; Naoki Takase; Akira Kodani, all of Kyoto, Japan

[73] Assignee: Sanyo Chemical Industries, Ltd., Kyoto, Japan

[21] Appl. No.: 261,034

[22] Filed: Jun. 14, 1994

[30] Foreign Application Priority Data

| | | | |
|---|---|---|---|
| Jun. 22, 1993 | [JP] | Japan | 5-176083 |
| Jun. 29, 1993 | [JP] | Japan | 5-186652 |
| Oct. 28, 1993 | [JP] | Japan | 5-294731 |
| Nov. 12, 1993 | [JP] | Japan | 5-307227 |
| Nov. 16, 1993 | [JP] | Japan | 5-309867 |
| Nov. 16, 1993 | [JP] | Japan | 5-309868 |

[51] Int. Cl.[6] ..... G03G 9/097

[52] U.S. Cl. ..... 430/110; 430/904

[58] Field of Search ..... 430/114, 115, 430/110, 109

[56] References Cited

U.S. PATENT DOCUMENTS

| | | | |
|---|---|---|---|
| 4,442,189 | 4/1984 | Lu et al. | 430/45 |
| 4,925,765 | 5/1990 | Madeleine | 430/110 |
| 5,213,740 | 5/1993 | Fuller | 267/140 |
| 5,356,748 | 10/1994 | Horie et al. | 430/115 |

FOREIGN PATENT DOCUMENTS

| | | |
|---|---|---|
| 0330287 | 8/1989 | European Pat. Off. . |
| 0421416 | 4/1991 | European Pat. Off. . |
| 4018986 | 12/1990 | Germany . |
| 4239135 | 5/1993 | Germany . |
| 2233105 | 1/1991 | United Kingdom . |

OTHER PUBLICATIONS

Patent Abstracts of Japan, vol. 17, No. 239 (P–1534) May 13, 1993 & JP–A–04 362 656 (Sanyo Chemical Industries, Ltd.) Dec. 15, 1992.

Patent Abstracts of Japan, vol. 10, No. 132 (P–456) May 16, 1986 & JP–A–60 254 155 (Konishiroku Shashin Kogyo KK).

*Primary Examiner*—John Goodrow

*Attorney, Agent, or Firm*—Wenderoth, Lind & Ponack

[57] ABSTRACT

A charge controller for an electrophotographic toner is disclosed which comprises a graft or block copolymer comprising:

(a) a polymer moiety having an alkyl group containing 6–50 carbon atoms and a carboxyl group, said moiety being selected from the group consisting of: a moiety of a polymer or a copolymer containing at least 5 mol. % of monomer units of a monoalkyl ester of an α,β-ethylenically unsaturated dicarboxylic acid, containing 6–50 carbon atoms in the alkyl group; and a moiety of a copolymer containing 5–75 mol. % of monomer units of a carboxylic group-containing α,β-ethylenically unsaturated monomer, and 6–80 mol. % of monomer units of an ethylenically unsaturated monomer having an alkyl group containing 6–50 carbon atoms; and (b) a polymer moiety, bound graft-wise or block-wise thereto, said moiety (b) being selected from the group consisting of a styrenic polymer moiety, and a polyester moiety.

The charge controller of the present invention can be used for an electrophotographic toner charging negatively by combining it with a toner binder and a colorant. As a charge controller of the invention has an excellent dispersing property in the toner, the toner is excellent in such properties as the electrostatic charge, the charging rate and transparency in using a color toner.

18 Claims, No Drawings

CHARGE CONTROLLER, TONER BINDER COMPOSITION AND ELECTROPHOTOGRAPHIC TONER

BACKGROUND OF THE INVENTION

1. Field of the Invention

The present invention relates to a charge control agent (hereinafter referred to as a charge controller), and a toner binder composition and an electrophotographic toner containing thereof. More precisely, the present invention relates to a charge controller charging negatively, and a toner binder composition and an electrophotographic toner containing thereof.

2. Description of the Prior Art

Previously a charge controller for the purpose of controlling the electrostatic charge of an electrophotographic toner has been employed. As the charge controllers charging negatively among the charge controllers previously known, there have been known an azo dyestuff compound, a salicylic acid-metal complex and the like.

In these days, however, it is a problem from the safety viewpoint that these compounds contain such heavy metals as chromium, cobalt and zinc, and these compounds are originally colored ones (for example, azo dyestuff). In addition, another problem is that it is difficult to disperse these compounds finely in the toner, and therefore, the charge distribution becomes wide. As improved compounds, such polymer compounds are proposed as follows:

1) Copolymer of α-olefin and maleic anhydride (U.S. Pat. No. 4,442,189).

2) Copolymer of styrene and maleic anhydride (Japan Patent Lay-open No.60-108861).

3) Block copolymer of methyl methacrylate and methacrylic acid (U.S. Pat. No. 4,925,765).

By using the polymer compounds disclosed in 1) and 2), the problems of coloring and safety were solved. However, the dispersing property into the toner is poor and other properties, such as the electrostatic charge of the toner, the charging rate and the environmental stability, are also inadequate. Furthermore, as the transparency is poor when toner is formulated, a bad influence to the color tone is observed in applying the color toner.

The compound disclosed in 3) is the one which is intended to improve the dispersing property in addition to coloring and safety. However, the amount of the electrostatic charge of the toner and the charging rate are inadequate, as the charge controller is hardly exposed to the surface of the toner.

It is an object of the present invention to obtain an essentially colorless charge controller containing no metal.

Another object of the invention is to obtain a charge controller having excellent properties concerning the electrostatic charge of the toner, the charging rate and the environmental stability.

Still another object of the invention is to obtain a charge controller having no problem concerning the above-mentioned dispersing property and transparency.

These and other objects of the present invention will become more readily apparent from the description hereinafter.

SUMMARY OF THE INVENTION

Briefly the above-mentioned objects of the present invention have been attained broadly by the following [1]–[5] aspects of the invention:

[1] An electrophotographic toner containing a toner binder, a colorant and a charge controller comprising an acid group-containing polymer, wherein:

1) at least a portion of said binder constitutes a continuous phase;

2) at least a portion of the charge controller constitutes discontinuous domains;

3) the charge controllers comprises a polymer moeity (α) forming the discontinuous domain, said moiety (α) having a solubility parameter same or lower by at most 2.5 than that of the continuous phase-forming binder (β);

4) said moiety (α) has an acid number of 50–400, and at least 3% of the acid group being a free acid group;

5) the acid group-containing polymer is a polymer or copolymer comprising units of at least one acid group-containing monomer selected from the group consisting of a carboxylic acid group-containing monomer, a sulfonic acid group-containing monomer, a phosphoric acid group-containing monomer and a boric acid group-containing monomer; and 6) said binder comprises at least one polymer selected from the group consisting of: a polymer or copolymer of at least one monomer selected from the group consisting of a styrenic monomer and an acrylic or methacrylic monomer; a polyester; an epoxy resin; a polyolefin; and a polyurethane.

[2] A charge controller which comprises a copolymer (AB) comprising:

a polymer moiety (a) having an alkyl group containing 6–50 carbon atoms and a carboxyl group, said moiety (a) being selected from the group consisting of (a1) a moiety of a polymer or a copolymer containing at least 5 mol. % of monomer units of (1) a monoalkyl ester of an α, β-ethylenically unsaturated dicarboxylic acid, containing 6–50 carbon atoms in the alkyl group, and (a2) a moiety of a copolymer containing 5–75 mol. % of monomer units of (2) a carboxylic group-containing α, β-ethylenically unsaturated monomer, and 6–80 mol. % of monomer units of (3) an ethylenically unsaturated monomer having an alkyl group containing 6–50 carbon atoms; and a polymer moiety (b), bound graft-wise or block-wise thereto, said moiety (b) being selected from the group consisting of (b1) a styrenic polymer moiety, and (b2) a polyester moiety.

[3] toner binder composition comprising the charge controller according to [2] and a toner binder comprises at least one polymer selected from the group consisting of: a polymer or copolymer of at least one monomer selected from the group consisting of a styrenic monomer and an acrylic or methacrylic monomer; a polyester; an epoxy resin; a polyolefin; and a polyurethane.

[4] An electrophotographic toner which comprises a toner binder a colorant and a charge controller according to [2].

[5] An electrophotographic toner, which comprises a toner binder, a colorant and a charge controller comprising a polymer (A) having an alkyl group containing 6–50 carbon atoms and carboxy group, said polymer (A) being selected from the group consisting of:

(A1) a polymer or copolymer containing at least 5 mol. % of monomer units of (1) a monoalkyl ester of an α, β-ethylenically unsaturated dicarboxylic acid, containing 6–50 carbon atoms in the alkyl group; and (A2) a copolymer containing 5–75 mol. % of monomer units of (2) a carboxylic group-containing α, β-ethylenically unsaturated monomer, and 6–80 mol. % of monomer units of (3) an ethylenically unsaturated monomer having an alkyl group containing 6–50 carbon atoms; and further comprises a polymeric compatibilizer (γ) having compatibility with both the polymer (A) and the toner binder.

DETAILED DESCRIPTION OF THE PREFERRED EMBODIMENTS

According to the present invention, suitable toner binders include such polymers used previously as toner binders, as styrenic polymers, polyesters, epoxy resins, polyolefins, polyurethanes and the like.

Suitable styrenic polymers include: a copolymer of styrene, acrylate or methacrylate and if necessary, other copolymerizable monomer; and a copolymer of styrene, diene monomers, such as butadiene and isoprene, and if necessary, other copolymerizable monomer.

Suitable polyesters include condensation polymers of aromatic dicarboxylic acids and oxyalkylene ether of a bisphenol.

Suitable epoxy resins include: a reaction product of aromatic diol and epichlorohydrine; and a modified compound thereof.

Suitable polyolefins include: polyethylene, polypropylene, a copolymer of ethylene or propylene with other copolymerizable monomer.

Suitable polyurethanes include: a polyaddition compound of aromatic diisocyanate and an alkylene oxide adduct of an aromatic diol.

According to the present invention, suitable colorants include such pigments and dyestuffs, used previously, as carbon black, iron black, Sudan black SM, First yellow G, Benzidine yellow, Pigment yellow, India first orange, Irgasine red, Baranito aniline red, Toluidine red, Carmine FB, Pigment orange R, Raykired 2G, Rodamine FB, Rodamine B rake, Methylviolette B rake, Phtharocyanine blue, Pigment blue, Brilliant green, Phtharocyanine green, Oil yellow GG, Kayaset YG, Orasol brawn B, Oil pink OP and the like.

According to the toner of the present invention mentioned above in [1], the properties described in the following paragraphs 1) and 2) can be determined by checking the existence of the interface through the examination of the cut of the toner by using a transmission electro-microscope:

1) There is a continuous phase in at least a portion of the toner,

2) There are discontinuous domains in at least a portion of the charge controller.

It is effective for a clear examination of the interface to examine the cut of the toner by using a electro-microscope after dying the cut with ruthenium tetraoxide, osmium tetraoxide and the like.

A suitable size of the dispersed particles of said domains as described in 2) is 0.01–0.8 μm, more preferably 0.05–0.5 μm. In case it is more than 0.8 μm, such problems occur as that the dispersibility is not sufficient, that the charge distribution becomes wide, and that the transparency of the toner becomes worse. On the other hand, in case it is less than 0.01 μm or in case the discontinuous domains are not formed and the charge controller is perfectly soluble in the binder, the content of the charge controller in the surface of the toner becomes poor and the amount of the charge becomes insufficient.

In order to make the size of the dispersed particle not more than 0.8 μm, a compatibilizer can be used in combination with other components.

Suitable compatibilizers include a polymeric compatibilizer (γ) which is compatible with not only said polymer chain (α) but also the continuous phase-forming toner binder (β).

Both (SPα): a solubility parameter of (α), and (SPβ): a solubility parameter of (β), can be calculated by such a previously known method as the calculation method of Fedors [the method written in Polym. Eng. Sci., 14[2], 147(1774)].

SPα–SPβ is generally from −2.5 to 0, preferably from −2.0 to −0.2. In case this value is more than 0 and (SPα) is larger than (SPβ), the content of the charge controller in the surface of the toner becomes small and the amount of the charge becomes insufficient. On the other hand, if the absolute value is more than |−2.5|, such problems occur as that the dispersing property becomes insufficient, that the charge distribution becomes wide and that the transparency of the toner becomes worse.

According to the invention of [1], suitable examples of the acid group-containing polymer contain a polymer or copolymer comprising units of at least one acid group-containing monomer selected from the group consisting of a carboxylic acid group-containing monomer, a sulfonic acid group-containing monomer, a phosphoric acid group-containing monomer and a boric acid group-containing monomer.

Suitable examples of the carboxylic acid group-containing monomer include an α, β-ethylenically unsaturated dicarboxylic acid, an α, β-ethylenically unsaturated dicarboxylic acid monoester, an α, β-ethylenically unsaturated dicarboxylic acid monoamide, acrylic or methacrylic acid; and the like.

Suitable examples of α, β-unsaturated dicarboxylic acid include maleic acid, fumaric acid, itaconic acid and the like.

Suitable examples of α, β-ethylenically unsaturated dicarboxylic acid monoester include monoesters of the above-mentioned α, β-ethylenically unsaturated dicarboxylic acid with such a compound as alcohols, phenols, mercaptanes, oxyalkylene group containing compounds or the like.

Suitable alcohols include: such alkanols containing 1–20 carbon atoms as methanol, ethanol, butanol, octanol, lauryl alcohol, stearyl alcohol and the like; such cycloalkyl alcohols as cyclohexanol and the like; such aralkyl alcohols as benzyl alcohol and the like; such fluoroalkylalcohols as perfluorobutylethanol, perfluorohexylethanol, perfluorooctylethanol and the like.

Suitable phenols include phenol, cresol, salicylic acid and the like.

Suitable mercaptans include alkyl mercaptan (such as lauryl mercaptan), thiophenol and the like.

Suitable oxyalkylene group-containing compounds include alkylene oxide (such as ethylene oxide, propylene oxide, and the like) adducts of the above-mentioned alcohols, phenols or mercaptans.

Suitable examples of an α, β-ethylenically unsaturated dicarboxylic acid monoamide include monoamide of the above-mentioned α, β-ethylenically unsaturated dicarboxylic acid with primary or secondary amines.

Suitable primary amines include: alkyl amines, such as ethyl amine, butyl amine, octyl amine, lauryl amine, stearyl amine and the like; aralkyl amines, such as benzyl amine and the like; and aryl amines, such as aniline and the like.

Suitable secondary amines include: dialkylamines, such as diethylamine, dibutylamine and the like; saturated heterocyclic amine compounds, such as cyclohexylamine and the like; and arylamines, such as aniline and the like.

Suitable examples of a sulfonic acid group-containing monomer include vinylsulfonic acid, allylsulfonic acid, styrenesulfonic acid, vinylbenzylsulfonic acid, 2-acrylamide-2-methyl-propanesulfonic acid and the like.

Suitable examples of a phosphoric acid group-containing monomer include a phosphoric acid ester of such hydroxyl group-containing monomer as vinylalcohol, allylalcohol, vinylphenol, hydroxy ethyl acrylate, hydroxy ethyl methacrylate or the like.

Suitable examples of a boric acid group-containing monomer include a boric acid of such hydroxyl group-containing monomer as vinyl alcohol, allylalcohol, vinylphenol, hydroxyethyl acrylate, hydroxyethyl methacrylate or the like.

It is allowable that some portion of the acid group is modified to be anhydride. However, at least 3% of the acid group in (α) is generally a free acid group which is not modified to be anhydride, and preferably more than 10% is the free acid group. In case the ratio of the free acid group is less than 3%, the amount of the charge becomes insufficient, and in addition, the charging rate becomes insufficient.

The acid group can also be present in the part outside (α). However, the acid number of acid group in (α) is generally 50–400. In case this value is less than 50, the amount of the charge becomes insufficient, and in case this value is more than 400, the exposure of the charge controller in the surface of the toner becomes insufficient and in addition, the environmental stability is less.

A preferred range of the above-mentioned acid number is influenced by the ratio of the free acid group in the acid group. That is to say, in case more than 70% of the acid group is the free acid group, a preferred range of the acid number is 50–300, more preferably 70–250, most preferably 80–200. As the ratio of the anhydride becomes greater, and in other words, as the ratio of the free acid group becomes smaller, the higher acid number is preferable. In case at least 30% to less than 70% of the acid group is the free acid group, the preferred range of the acid number is 60–350, more preferably 80–300, most preferably 100–250. In case at least 3% to less than 30% of the acid group is the free acid group, the preferred range of the acid value is 80–400, more preferably 100–350, most preferably 150–300.

The acid number of (α) can be calculated, according to the general method, by titration with such alkaline compounds as potassium hydroxide and sodium hydroxide. In case at least one part of the acid group is anhydride, it is preferable for a correct titration to neutralize with excess alkaline and then titrate the residual alkaline with such strong acid as hydrochloride.

In case the acid group is also present in the portion except (α), the acid number can be calculated by the titration after the isolation of the portion forming (α) or the portion except. (α).

In case the structure can be correctly examined by such a spectrometric method as NMR, the acid number can be calculated from the content of acid group.

Suitable methods to determine the ratio of free acid group, in case a portion of the acid group is modified to be anhydride, include such methods as: calculating the acid number and the acid anhydride value after titration and then calculating the differential thereof; and such a spectroscopic analysis as IR, NMR or the like.

The polymer chain (α) preferably has a melting point of 25°–100° C. or has not a melting point but has a glass transition point of 25°–100° C. In case the melting point is less than 25°·C. or in case no melting point is observed and the glass transition point is less than 25° C., the flowability and the shelf stability tend to be reduced. On the other hand, in case the melting point is more than 100° C. or in case the melting point is not observed but the glass transition point is more than 100° C., it becomes difficult to blend the charge controller in the toner and the charge distribution tends to be wide.

Suitable (α) is the crystallizable polymer chain possessing a melting point, because the charge controller is, in this case, likely to be disposed in the surface of the toner, and therefore, the required amount of the charge is attained by a small amount of the charge controller.

The melting point and the glass transition point can be, according to the general method, determined by the examination of the polymer or the electrophotographic toner containing (α) with DSC of the peak thermally absorbed or differential of the specific heat.

Suitable charge controllers having the above-mentioned properties include a polymer(A) containing a alkyl group having 6–50 carbon atoms and a carboxyl group.

Suitable examples of the polymer (A) include:

(A1): a polymer or copolymer containing at least 5 mol. % of monomer units of (1) a monoalkyl ester of an α, β-ethylenically unsaturated dicarboxylic acid containing 6–50 carbon atoms in the alkyl group; and (A2) a copolymer containing 5–75 mol. % of monomer units of (2) a carboxylic group-containing α, β-ethylenically unsaturated monomer, and 6–80 mol. % of monomer units of (3) an ethylenically unsaturated monomer having an alkyl group containing 6–50 carbon atoms.

The polymer or copolymer (A1) include both a homopolymer of (1), and a copolymer of (1) and another copolymerizable monomer (4).

Suitable examples of (1) include monoalkyl maleate, monoalkyl itaconate, monoalkyl fumarate and the like. Preferred among them are monoalkyl maleate and monoalkyl itaconate, more preferably monoalkyl itaconate.

The number of the carbon atoms of the alkyl group of (1) is generally 6–50, preferably 10–40. In addition, a linear alkyl group is more preferable than a branched one.

In case the number of the carbon atoms of the alkyl group in (1) is less than 6, the solubility parameter of (α) becomes greater and therefore, the exposure of the charge controller in the surface of the toner becomes insufficient and the amount of the charge becomes insufficient, and in addition, the glass transition temperature becomes higher and the charge controller becomes hardly dispersed in the toner.

In case the number exceeds 50, the concentration of the carboxylic acid group becomes smaller, and therefore, the amount of the charge becomes insufficient and also the start of charging becomes worse.

In case the alkyl group has many branches, the flowing ability and the shelf stability of the toner tends to be reduced.

Suitable examples of another copolymerizable monomer (4) in (1) include:

(4-1) α, β-ethylenically unsaturated dicarboxylic acid and anhydride thereof;

(4-2) α, β-ethylenically unsaturated dicarboxylic acid dialkyl ester; and (4-3) another monomer.

Suitable examples of (4-1) include maleic acid, itaconic acid, fumaric acid and anhydride thereof. Preferred among them are the same compound as the dicarboxylic acid which composes (1) and the anhydride thereof.

Suitable examples of α, β-ethylenically unsaturated dicarboxylic acid dialkyl ester (4-2) include dialkyl esters in the (4-1), and preferred are, in the same way as (4-1), dialkyl esters of the dicarboxylic acid which composes (1).

Suitable examples of another monomer (4-3) include: such lower olefins as ethylene propylene, 1-butene, isobutylene and the like; such vinyl ethers as methyl vinyl ethers, butyl vinyl ethers and the like; such vinyl halides as vinyl chloride and the like; such vinyl esters as vinyl acetate, vinyl propionate and the like; such aromatic vinyl hydrocarbons as styrene, α-methylstyrene, p-cumylstyrene and the like; (meth)acrylic acid ; such (meth)acrylic acid esters as methyl (meth)acrylate, ethyl (meth)acrylate, butyl (meth)acrylate and the like; such diene as butadiene, isoprene and the like; and such monomers having nitrile group as (meth)acrilonitrile and the like.

Preferred among them are, in case (1) is monoalkyl maleate, lower olefins and aromatic vinyl hydrocarbons, and in case (1) is another α, β-unsaturated dicarboxylic acid monoalkyl ester, lower olefins, aromatic vinyl hydrocarbons, (meth)acrylic acid and (meth)acrylates.

The mol. % of (1) unit in the polymer (A1) is, in case (1)is monoalkyl maleate, generally 5–100 mol. %, preferably 10–60 mol. %. In case (1) is another α, β-unsaturated dicarboxylic acid monoalkyl ester, the mol. % of (1) unit is generally 5–100 mol. %, preferably 20–100 mol. %. In case (1) unit is less than 5 mol. %, the amount of the charge becomes insufficient.

The mol. ratio of copolymerization, in case (4-1) and/or (4-2) are used together with (1), is generally in the range that (1):[(4-1)+(4-2)] is 10:0–2:8 and [(1)+2(4-1)]:[(1)+2(4-2)] is 5:1–1:3, and preferably in the range that (1):[(4-1)+(4-2)] is 10:0–4:6 and [(1)+2(4-1)]:[(1)+2(4-2)] is 2:1–1:2.

The mol. % of (4-3) unit in the copolymer (A1), in case (4-3) is used, is generally 0–70 mol. % when monoalkyl maleate is used as (1), and generally 0–60 mol. %, preferably 0–20 mol. % when another α, β-ethylenically unsaturated dicarboxylic acid monoalkyl ester is used as (1).

Suitable examples of (2) a carboxylic group-containing α, β-ethylenically unsaturated monomer include:

(2-4) an α, β-ethylenically unsaturated dicarboxylic acid;

(2-1) an α, β-ethylenically unsaturated dicarboxylic acid monoester;

(2-2) an α,β-ethylenically unsaturated dicarboxylic acid monoamide;

(2-3) acrylic or methacrylic acid; and the like.

Among these, preferred are (2-1), (2-2) and (2-3).

Suitable examples of (2-4) α, β-unsaturated dicarboxyl acid include maleic acid, fumaric acid, itaconic acid and the like.

Suitable examples of (2-1) α, β-ethylenically unsaturated dicarboxylic acid monoester include monoesters of the above-mentioned (2-4) α, β-ethylenically unsaturated dicarboxylic acid with such a compound as alcohols, phenols mercaptans, oxyalkylene group containing compounds or the like.

Suitable alcohols include: such alkanols containing 1–20 carbon atoms as methanol, ethanol, butanol, octanol, lauryl alcohol, stearyl alcohol and the like; such cycloalkyl alcohols as cyclohexanol and the like; such aralkyl alcohols as benzyl alcohol and the like; such fluoroalkyl alcohols as perfluorobutyl ethanol, perfluorohexyl ethanol, perfluorooctyl ethanol and the like.

Suitable phenols include phenol, cresol, salicylic acid and the like.

Suitable mercaptans include alkyl mercaptan (such as lauryl mercaptan), thiophenol and the like.

Suitable oxyalkylene group containg compounds include alkylene oxide (such as ethylene oxide, propylene oxide, and the like) adducts of the above-mentioned alcohols, phenols or mercaptans.

Suitable examples of (2-2) an α, β-ethylenically unsaturated dicarboxylic acid monoamide include monoamide of the above-mentioned α, β-ethylenically unsaturated dicarboxylic acid with primary or secondary amines.

Suitable primary amines include: alkyl amines, such as ethyl amine, butyl amine, octyl amine, lauryl amine, stearyl amine and the like; cycloalkylamines, such as cyclohexylamine and the like; aralkyl amines, such as benzyl amine and the like; and aryl amines, such as aniline and the like.

Suitable secondary amines include: dialkylamines, such as diethylamine, dibutylamine and the like; a saturated heterocyclic amines, such as piperidine, morpholine and the like; and arylamines, such as aniline and the like.

Suitable examples of (3) an ethylenically unsaturated monomer having an alkyl group containing 6–50 carbon atoms include:

(3-1) an ethylenically unsaturated ester compound having an alkyl group containing 6–50 carbon atoms;

(3-2) α-olefin having 8–52 carbon atoms; and (3-3) alkyl vinyl ether having an alkyl group containing 6–50 carbon atoms.

Suitable examples of (3-1) include: (3-1*a*) carboalkoxy group containing monomer; and (3-1*b*) acyloxy group containing monomer, and )3-1*a*) is preferable.

Suitable examples of (3-1*a*) include alkyl acrylate, alkyl methacrylate and α, β-ethylenically unsaturated dicarboxylic acid mono- or dialkyl ester.

Suitable examples of (3-1*b*) include an alkanoic acid vinyl ester, an alkanic acid aryl ester and the like. And suitable alkanoic acids which compose these esters include: such linear alkanoic acids as octanoic acid, lauric acid, stearic acid, behenic acid and the like ;and such branched alkanoic acids as isostearic acid and the like.

Suitable examples of (3-2) include 1-octene, 1-decene, 1-dodecene, 1-tetradecene, 1-hexadecene, 1-octadecene, 1-eicosene, 1-docosene, 1-tetracosene, 1-hexacosene, 1-octacosene, 1-triacontene and the mixture of at least 2 of them. Among these, preferred are α-olefin containing 12–40 carbon atoms and the mixture of at least 2 of them.

Suitable examples of (3-3) include hexyl vinyl ether, octyl vinyl ether, lauryl vinyl ether, cetyl vinyl ether, stearyl vinyl ether, behenyl vinyl ether and the like. Among these, preferred are vinyl ethers having alkyl group containing 10–22 carbon atoms.

Suitable examples of the copolymer (A2) include either a copolymer of (2) and (3) or a copolymer of (2), (3) and another copolymerizable monomer(5).

Suitable examples of said monomer (5) include:

(5-1) an anhydride of α, β-ethylenically unsaturated dicarboxylic acid; and (5-2) another monomer.

Suitable examples of (5-1) an anhydride of α, β-unsaturated dicarboxylic acid include the anhydride of (2-4) an α, β-ethylenically unsaturated dicarboxylic acid.

Suitable examples of (5-2) another monomer include: such lower olefins as ethylene propylene, 1-butene, isobutylene and the like; such lower vinyl ethers as methyl vinyl ethers, butyl vinyl ethers and the like; such vinyl halides as vinyl chloride and the like; such vinyl esters as vinyl acetate, vinyl propionate and the like ;such aromatic vinyl hydrocarbons as styrene, α-methylstyrene, p-cumylstyrene and the like; such acrylic or methacrylic acid lower esters as methyl acrylate, methyl methacrylate, ethyl acrylate, ethyl methacrylate, butyl acrylate, butyl methacrylate and the like; such dienes as butadiene, isoprene and the like ;and such monomers having nitrile group as acrylonitrile, methacrylonitrile and the like.

Preferred among them, in case (5) is used, are lower olefins, aromatic vinyl hydrocarbons, and acrylic or methacrylic acid lower esters.

In the copolymer (A2), the copolymerization ratio in mol. % is generally 5–75 mol. % of (2), 6–80 mol. % of (3) and 0–89 mol. % of (5), and in case (5-1) is not used as (5), the ratio is preferably 30–70 mol. % of (2), 30–70 mol. % of (3 ) and 0–40 mol. % of (5-2). In case (5-1) is used as (5), the ratio is preferably 5–50 mol. % of (2), 30–70 mol. % of (3) and 0–40 mol. % of (5-2).

In case the copolymerization ratio of (2) is less than 5 mol. %, the charge controller is hardly exposed to the surface of the toner, and therefore, the amount of the charge becomes insufficient.

In case the copolymerization ratio of (3) is less than 6 mol. %, the charge controller hardly exposes to the surface of the toner, and therefore, the amount of the electrostatic charge becomes insufficient, and in case the ratio of (3) exceeds 80 mol. %, the amount of the charge becomes insufficient and the charging rate becomes worse.

In case the copolymerization ratio of (5-1) is more than 5 mol. %, the amount of the charge hardly becomes insufficient even if the copolymerization ratio of (2) is rather small, however, in case the copolymerization ratio of (2) is less than 5 mol. %, it becomes insufficient.

According to the present invention, the weight average molecular weight of (A) is generally 1,000–500,000, preferably 2,000–200,000. In case it is less than 1,000, it becomes difficult to form the discontinuous domains and a perfect compatibility with the binder is observed, and therefore, the amount of the charge becomes insufficient and the flowing ability of the toner is reduced. On the other hand, in case it is more than 500,000, it becomes difficult to disperse (A) in the toner.

Suitable examples of the polymer (A) include: either 1) a polymer (AA) having an alkyl group containing 6–50 carbon atoms and a carboxyl group and free from said moiety (b), said polymer (AA) being selected from the group consisting of said polymer (A1) and said polymer (A2); or 2) a copolymer (AB) comprising:

a polymer moiety (a) having an alkyl group containing 6–50 carbon atoms and a carboxyl group, said moiety (a) being selected from the group consisting of (a1) a moiety of a polymer or a copolymer containing at least 5 mol. % of monomer units of (1) a monoalkyl ester of an α, β-ethylenically unsaturated dicarboxylic acid, containing 6–50 carbon atoms in the alkyl group, and (a2) a moiety of a copolymer containing 5–75 mol. % of monomer units of (2) a carboxylic group-containing α, β-ethylenically unsaturated monomer, and 6–80 mol. % of monomer units of (3) an ethylenically unsaturated monomer having an alkyl group containing 6–50 carbon atoms; and a polymer moiety (b), bound graft-wise or block-wise thereto, said moiety (b) being selected from the group consisting of (b1) a styrenic polymer moiety, and (b2) a polyester moiety.

Among these, preferred is (AB) as the particles of the discontinuous domains (α) formed with (a) in the toner can be easily formed in a small size. Furthermore, in order to obtain this effect, it is more preferable that the structure of (b) resemble the toner binder. Accordingly, (b1) is preferable as (b) in case the styrenic polymer is used as the toner binder, and (b2) is preferable as (b) in case polyester is used as the toner binder.

In order to make the particle size smaller, the total amount of (A) is not necessarily (AB) and (AB) as a portion of (A) is sufficient. That is to say, (AA) can be contained together with (AB). In such case, (α) is formed by both (a) and (AA).

In addition, a polymer (B) selected from the group consisting of:

(B1) a styrenic polymer free from the moiety (a); and (B2) a polyester free from the moiety (a) can be contained in combination with (AB) and/or (AA).

Preferred as (AA) and (a) are same as the case of (A).

The weight ratio of (AB), (AA) and (B), in case of being grafted or blocked, is generally 1–100% by weight of (AB), 0–99% by weight of (AA) and 0–90% by weight of (B), preferably 10–100% of (AB), 0–90% of (AA) and 0–50% of (B).

If the weight ratio of (AB) is less than 1%, it becomes difficult to make the particle size of (α) small, and if (B) exceeds 90%, a lot of charge controller is required in order to get an adequate charge and it is not economical.

In the charge controller of the invention, (Wa) [the total content of (a) and (AA)] is generally 10–99% by weight, preferably 20–90%, and (Wb) [the total content of (b) and (B)] is generally 1–90% by weight, preferably 10–80%.

If (Wa) is less than 10%, a lot of charge controller is required in order to get an adequate charge and it is not economical. If (Wa) exceeds 99%, it becomes difficult to make the particle size of (α) small.

According to the present invention, suitable styrenic polymers composing (b1) include either styrene homopolymer or copolymer of styrene and another copolymerizable monomer (6).

Suitable examples of the other copolymerizable monomer (6) include an aromatic vinyl hydrocarbon except for styrene, an acrylic or methacrylic monomer and another vinyl monomer.

Suitable examples of an aromatic vinyl hydrocarbon except for styrene include a styrene substitute, such as: alkyl substituted styrenes (α-methylstyrene, p-methylstyrene, p-cumylstyrene and the like); halogen substituted styrenes (chlorostyrene, chloromethylstyrene and the like; acetoxystyrene and hydroxystyrene.

Suitable examples of an acrylic or methacrylic monomer include acrylate or methacrylates, such as: alkyl acrylates or methacrylate containing alkyl group having 1–18 carbon atoms [methyl acrylate or methacrylate, ethyl acrylate or methacrylate, butyl acrylate or methacrylate, 2-ethylhexyl acrylate or methacrylate, lauryl acrylate or methacrylate, stearyl acrylate or methacrylate or the like]; hydroxyl group containing acrylate or methacrylate [hydroxyethyl acrylate or methacrylate or the like]; epoxy group containing acrylate or methacrylate [glycidyl acrylate or methacrylate or the like]; isocyanate group containing monomer [methacryloyl isocyanate or the like]; and nitrile group containing monomer [acrylonitrile, methacrylonitrile or the like].

Suitable examples of the other vinyl monomer include: vinyl ester, such as vinyl acetate, vinyl propionate or the like; diene monomer, such as butadiene, isoprene or the like; halogenated olefin, such as vinyl chloride, vinyl bromide or the like; α, β-ethylenically unsaturated mono- or polycarboxylic acid, such as acrylic acid, methacrylic acid, crotonic acid, sorbinic acid, maleic acid, itaconic acid, synnamic acid or the like; anhydride thereof, such as maleic anhydride or the like; and half ester thereof, such as monomethyl maleate or the like.

Preferable styrenic polymers composing (b1) are styrene homopolymers, copolymers of styrene and acrylic or methacrylic monomers, copolymers of styrene and diene monomers, and copolymers of these monomers and a small amount of other copolymerizable monomers.

Furthermore, if the styrenic polymer is a copolymer, the copolymerizing ratio of styrene and other monomer(6) is generally not less than 40 mol. % of styrene, preferably not less than 60 mol. %.

According to the present invention, suitable examples of the polyester composing (b2) include a condensation polymer of polyol (7) and polycarboxylic acid (8).

Suitable examples of polyol (7) include diol (7-1) and not less than trivalent polyol (7-2), preferably (7-1) and a mixture of (7-1) and a small amount of (7-2).

Suitable examples of diol (7-1) include: alkylene glycol having 2–12 carbon atoms, such as ethylene glycol, 1,2-propylene glycol, 1,3-propylene glycol, 1,4-butane diol, 1,6-hexane diol or the like; alkylene ether glycol, such as diethylene glycol, triethylene glycol, dipropylene glycol, polyethylene glycol, polypropylene glycol, polytetramethylene glycol or the like; alicyclic diol, such as 1,4-cyclohexane dimethanol, hydrogenated bisphenols, such as bisphenol A, bisphenol F, bisphenol S or the like; and an alkylene oxide (ethylene oxide, propylene oxide, butylene oxide or the like) adduct of the above-mentioned bisphenols.

Among these, preferable are alkylene glycol having 2–12 carbon atoms, alkylene oxide adduct of bisphenols and combination thereof.

Suitable examples of not less than trivalent polyol (7-2) include aliphatic polyol having 3–20 carbon atoms, such as glycerol, trimethylolethane, trimethylolpropane, pentaerythritol, sorbitol or the like ; not less than trivalent phenols, such as trisphenol PA, phenol novolac, cresol novolac or the like, an oxyalkylene ether of the above-mentioned not less than trivalent phenols.

Suitable examples of polycarboxylic acid(8) include dicarboxylic acid (8-1) and not less than trivalent polycarboxylic acid (8-2), preferably (8-1) and a mixture of (8-1) and small amount of (8-2).

Suitable examples of the dicarboxylic acid (8-1) include: an alkylene dicarboxylic acid having 2–20 carbon atoms, such as succinic acid, adipic acid, sebacic acid or the like; an alkenylene dicarboxylic acid, such as maleic acid, fumaric acid or the like; and an aromatic dicarboxylic acid having 8–20 carbon atoms, such as phthalic acid, isophthalic acid, terephthalic acid, naphthalene dicarboxylic acid or the like.

Among these, preferable are the alkylene dicarboxylic acid having 2–20 carbon atoms and the aromatic dicarboxylic acid having 8–20 carbon atoms.

Suitable examples of not less than trivalent polycarboxylic acid (8-2) include an aromatic polycarboxylic acid having 9–20 carbon atom, such as trimellitic acid, pyromellitic acid or the like.

The mol. ratio of (7) and (8) which compose the polyester moiety (b2) is generally 1:2–2:1, preferably 1:1.5–1.5:1.

The mol. ratio of (7-1) and (7-2) in (7) is generally 100:0–80:20, preferably 100:0–90:10.

The suitable mol. ratio of (8-1) and (8-2) in (8) is same as the mol. ratio of (7-1) and (7-2).

In addition, preferable as (B1) and (B2) are same as in the case of (b1) and (b2).

Suitable examples of the copolymer (AB), wherein (b) connected by being grafted or blocked with (a) include the following:

1) A graft copolymer wherein a branched polymer chain of (b) is grafted to a main polymer chain of (a).
2) A graft copolymer wherein a branched polymer chain of (a) is grafted to a main polymer chain of (b).
3) A block copolymer of (a) and (b).

Among these, preferable are the graft copolymers 1) and 2).

The weight average molecular weight of each (a) and (b) is generally 1,000–100,000 for (a) and 1,000–500,000 for (b), preferably 2,000–50,000 for (a) and 3,000–100,000 for (b).

If the weight average molecular weight for (a) or (b) less than 1,000, the flowing property of the toner is badly influenced, and if (a) exceeds 100,000 or (b) exceeds 500,000, the charge controller can hardly disperse in the toner.

Suitable examples of (AA) among the polymer (A) contain the following:

1) Monostearyl itaconate homopolymer.
2) Monolauryl itaconate homopolymer.
3) Monostearyl itaconate/itaconic acid anhydride (80/20) copolymer.
4) Monostearyl itaconate/distearyl itaconate (90/10) copolymer
5) Monostearyl itaconate/acrylic acid/butyl acrylate (98/1/1 ) copolymer.
6) Monolauryl itaconate/acrylic acid/methyl acrylate (98/1/1 ) copolymer.
7) Monocetyl maleate/maleic anhydride/styrene (30/20/50) copolymer.
8) Stearyl methacrylate/methacrylic acid (60/40) copolymer.
9) Stearyl methacrylate/methacrylic acid/styrene (50/30/20) copolymer.
10) The mixture of 1-alkenes of C12 and C14/monostearyl maleate/maleic anhydride (50/20/30) copolymer.
11) The mixture of 1-alkenes of C16 and C18/monoperfluorooctylethyl maleate (50/50) copolymer.
12) The mixture of 1-alkenes of C16 and C18/monobutyl maleate/maleic anhydride (50/25/25) copolymer.
13) 1-octadecene/monostearyl maleate/maleic anhydride (50/15/35) copolymer.
14) The mixture of 1-alkenes of C20–C28/monobutyl maleate/maleic anhydride (50/15/35) copolymer.
15) The mixture of 1-alkenes of C30–C40/monobutyl maleate/maleic anhydride (50/12/38) copolymer.
16) Stearylvinyl ether/monobutyl maleate/maleic anhydride (50/15/35) copolymer.
17) Isobutylene/monostearyl maleate/maleic anhydride (50/30/20 ) copolymer.

Suitable examples of copolymer (AB) of (a) and (b) include graft copolymers of the moiety of (AA) illustrated in the above and the moiety (b) illustrated as follows:

1) A moiety of styrene homopolymer.
2) A moiety of styrene/butyl acrylate (95/5) copolymer.
3) A moiety of styrene/butyl acrylate (87/13) copolymer.
4) A moiety of styrene/butyl methacrylate (75/25) copolymer.
5) A moiety of styrene/butadiene (90/10) copolymer moiety.
6) A moiety of bisphenol A propylene oxide 2 mol. adduct/isophthalic acid condensation polymer.
7) A moiety of bisphenol A propylene oxide 2 mol. adduct/terephthalic acid condensation polymer.

8) A moiety of bisphenol A ethylene oxide 2 mol. adduct/maleic acid condensation polymer.
9) A moiety of bisphenol A propylene oxide 3 mol. adduct/maleic acid condensation polymer.
10) A moiety of bisphenol A ethylene oxide 3 mol. adduct/terephthalic acid condensation polymer.

Illustrative preparation method of the polymer (A) in the present invention is as follows:

The polymer (AA) is obtained by polymerizing the monomers required to be the aimed structure from the first stage of the reaction. For example, (AA) is obtained by polymerizing (1) under the presence of azobisisobutyronitrile. On the other hand, (AA) is also obtained by copolymerizing the monomer having group available for leading to be aimed (AA), and then additionally reacting to obtain the aimed copolymer (AA). Namely, in the case of the copolymer of (2-1) and (3), the aimed copolymer can be obtained by copolymerizing (3) and (5-1), and reacting alcohols thereafter.

Illustrative preparation methods of the graft or block copolymer (AB) in the present invention are as follows:

1) Macromer method of obtaining graft copolymer by copolymerizing a compound having a structure that introduces a polymerizable group, such as aryl group, in the end of the styrenic polymer moiety or polyester moiety (b), with the monomers composing (a) by which the copolymer moiety (a) can be introduced.
2) Polymer reaction method of obtaining a copolymer by copolymerizing a compound having a structure of being introduced a group reactive with the copolymer moiety (a), such as amino group or hydroxyl group, in the end of the styrenic polymer moiety or polyester moiety (b), with the reactable group in the side chain of the copolymer moiety (a), such as carboxyl group or acid anhydride group.
3) Main chain initiating polymerization method of obtaining graft copolymer by reacting a compound having a structure that introduces a polymerization initiating group, such as peroxide group, in tile side chain of the styrenic polymer moiety or polyester moiety (b), and the monomers composing (a) by which the copolymer moiety (a) can be introduced; or by reacting a compound having a structure of introducing polymerization initiating group in the side chain of (a), with styrene and, if necessary, another copolymerizable monomer.

The preparation method of (a) is fundamentally the same as the above-mentioned production method of (AA). For example, the method of introducing a group reactive with the group situated in the end of (b), such as carboxyl group or acid anhydride group, is same as the preparation method of the above-mentioned (AA), as (a) has surely a carboxyl group, and in order to introduce acid anhydride group, (a) is obtained by copolymerizing a monomer having an acid anhydride group, such as (5-1) in the same way as the preparation method of (AA) before the polymerization of the monomers composing (a) .

Methods of introducing a polymerization initiating group in the side chain of (a) include, for example: a method of reacting hydroperoxide with (a) having a acid anhydride group. In addition, the same effect can be obtained by copolymerizing, in (a), a small amount of such monomer as acrylic acid or lower alkyl ester thereof, which has a potential of starting a chain transfer reaction.

The compound having a structure for introducing the above-mentioned reactive group in the end or side chain of the styrenic polymer moiety (b1) can be prepared by using conventional methods.

For example, a compound having a hydroxyl group in the end of (b1) is prepared by a radical copolymerization of styrene and another copolymerizable monomer (f) under the presence of a hydroxyl group-containing chain transfer agent.

A compound having a hydroxyl group in the end of the polyester moiety (b2) can be also prepared by using conventional methods.

For example, a compound having a hydroxyl group in the end of (b2) is prepared by using excess amount of polyol (7) in the condensation polymerization process of polyol (7) and polycarboxylic acid (8) which compose (b2). A compound having a metacryloyl group in the end of (b2) can be obtained by reacting methacryloyl isocyanate with the above-mentioned (b2) having hydroxyl group.

In addition, in preparing (b2), polyol (7) and polycarboxylic acid (8) are, not necessarily, applied for the condensation polymerization. The aimed polyester moiety (b2) can also be prepared by applying such derivative of (7) as lower monocarboxylic acid ester, alcoholate or the like and/or such derivative of (8) as lower alcohol (such as methanol) ester, acid anhydride, acid halide or the like, for condensation polymerization.

The charge controller of the invention [2] can be preliminary mixed with a toner binder, before preparing the toner, to be used as a toner binder composition of the invention having a charge controlling property.

Suitable toner binders of the invention include the same ones mentioned above, and the preferable combinations of the toner binder and (b), in case the charge controller containing (AB), are also the same mentioned above.

Illustrative methods of preparing the toner binder composition of the invention include the following:

1) Method of polymerizing the monomers for preparing the toner binder mentioned above under the presence of the charge controller.
2) Method of mixing the toner binder and the charge controller in the solvent, such as an aromatic hydrocarbon (toluene, xylene or the like), a halogenated compound (chloroform, ethylene dichloride or the like), ketone (acetone, methylethyl ketone or the like) or amide (dimethylformamide or the like).
3) Method of thermally melting and mixing the toner binder and the charge controller.

Both of the charge controller and the toner binder composition of the invention can be used for the electrophotographic toner of the invention containing them.

According to the toner binder composition and the electrophotographic toner of the invention, the weight ratio of the polymer (A) on the basis of the weight of the toner binder is generally 0.1–20% by weight, preferably 0.3–10%.

If the weight ratio of (A) is less than 0.1%, the charge in the toner is small, and if it is more than 20%, the environmental stability of the toner becomes worse.

The ratio of the components of the electrophotographic toner of the present invention based on the weight of the toner is generally 40–97% by weight of the total amount of the charge controller and toner binder, 0–15% by weight of the colorant, and if necessary, less than 60% by weight of a magnetic powder, such as a powder of strong magnetic metal (iron, cobalt, nickel or the like), magnetite, hematite, ferrite or the like, said magnetic powder being as a compound having also a property of a colorant.

In addition, many additives can be contained, such as a lubricant (polytetrafluoroethylene, low molecular weight polyolefin, fatty acid or metal salt or amide thereof or the like) and the other charge controllers (azo dyestuff containing metal, salicylic acid metal salt or the like). Furthermore, a micropowder of hydrophobic colloidal silica can be used in order to improve the flowing property of the toner. The amount of these additives based on the weight of the toner is generally less than 10% by weight.

In addition, to make the particle size of (α) formed by (A), smaller, a polymeric solubilizer (γ) having a compatibilizing property with (A) and the toner binder can be included.

Suitable examples of (γ) include a polymer having a polymer chain, containing not less than 50 mol. % of a monomer unit having substantially the same structure as the unit monomer of (A), bound graft-wise or block-wise to a polymer chain, containing not less than 50 mol. % of a monomer unit having substantially the same structure as the unit monomer of the toner binder.

That is to say, the above-mentioned (AB) is the most effective compatibilizer. However, (γ) does not necessarily contain carboxyl group but contains alkyl group having 6–50 carbon atoms.

The amount of (γ) used based on the amount of (A) is generally 0.1–30% by weight, preferably 1–10%.

The preparation method of the electrophotographic toner of the invention is not limited. Illustrative methods of the same are as follows:

1) Kneading and pulverizing method

The components of the toner are blended in the dry atmosphere, and kneaded thereafter, and then roughly crushed and finally made into a fine powder using a jet mill or the like.

Furthermore, the product is classified into a fine powder having a particle size of 5–20 μm, to obtain the toner.

2) Additional blending method

The charge controller of the invention is blended, in the dry atmosphere, with particles having 5–20 μm in diameter, comprising the toner binder, the colorant, and if necessary, the lubricant and the magnetic powder, and then the blended product is further mixed hardly, if necessary, under heating condition, with a mixer, to obtain the toner.

3) Polymerization method

The charge controller of the invention, the colorant and the other components are dispersed and dissolved in the raw material monomers of the toner binder, and then after the suspension polymerization is done in the water, the product is dried into a fine powder having 5–20 μm diameter, to obtain the toner.

The electrophotographic toner of the invention is, if necessary, mixed with carrier powder, such as iron powder, glass bead, nickel powder or the like, and used as a developer for an electrophotographic latent image.

The electrophotographic toner of the invention is fixed on the substrate, such as a paper, a polyester film or the like, with a copying machine, to be a printed matter. Illustrative fixing methods on the substrate include a heat roll fixing method.

Having generally described the invention, a more complete understanding can be obtained by reference to certain specific examples, which are included for purposes of illustration only and not intended to be limiting unless otherwise specified. Hereinafter, part(s) means weight part(s).

Example A1

In toluene at the boiling point, 663 parts of stearyl methacrylate and 167 parts of styrene were polymerized for 4 hours using 30 parts of azobisisobutyronitrile, and then toluene was distilled off, to obtain the charge controller (A1) of the present invention having a weight average molecular weight of 15,000.

Comparative Examples CA1 and CA2.

In the same manner as Example A1 except that methacrylic acid was not added, the charge controller (CA1) for comparison was obtained. On the other hand, in the same manner as Example A1 except that stearyl methacrylate was not added, the charge controller (CA2) for comparison was obtained.

Example A2

10,000 parts of itaconic acid anhydride was bulk-polymerized at 80° C. for 4 hours using 30 parts of azobisisobutyronitrile, and after dissolving in acetone, chloroform was added,to obtain a precipitate. After the filtration of the precipitate, it was dried in the reduced pressure, to obtain polyitaconic acidanhydride (a).

Then 695 parts of stearyl alcohol was added to 305 parts of polyitaconic acid anhydride (a) and the half-esterifying reaction was done in MIBK at the boiling point for 5 hours, to obtain the charge controller (A2) of the present invention having a weight average molecular weight of 10,000.

According to the result of DSC measurement of the charge controller (A2), a thermal absorbent peak owing to the melting point was observed at 43° C.

Comparative Example CA3

In the same manner as Example A2 except that 190 parts of butanol was used for the half-esterification, the charge controller (CA3) for comparison was obtained.

Example A3

980 parts of monolauryl itaconate, 10 parts of acrylic acid and 10 parts of methyl acrylate were bulk-polymerized at 95° C. for 20 hours using 10 parts of azobiscyclohexanecarbonitrile, and after dissolving in THF, acetone was added,to obtain a precipitate. After the filtration of the precipitate, it was dried in the reduced pressure, to obtain the charge controller (A3) of the invention having a weight average molecular weight of 12,000.

According to the result of DSC measurement of the charge controller(A3), the glass transition point was observed at 50° C.

Example A4

990 parts of monostearyl itaconate, 5 parts of acrylic acid and 5 parts of butyl acrylate was polymerized in the same manner as Example A3, to obtain the charge controller (A4) of the invention having a weight average molecular weight of 15,000.

According to the result of DSC measurement of the charge controller (A4), a thermal absorbent peak owing to the melting point was observed at 41° C.

Example A5

In EDC at the boiling point, 208 parts of maleic anhydride and 220 parts of styrene were copolymerized using 30 parts of azobisisobutyronitrile as a initiator, and then after 572 parts of stearyl alcohol was added, half esterifying reaction was done for 5 hours, to obtain the charge controller (A5) of the invention.

Comparative Example CA4

In the same manner as Example A5 except that 157 parts of butanol was used instead of 572 parts of stearyl alcohol for the half-esterification, the charge controller (CA4) for comparison was obtained.

Example A6

In toluene at the boiling point, 767 parts of a mixture of 1-alkene of C20-C26 and 233 parts of maleic anhydride were polymerized for 5 hours using 200 parts of azobisisobutyronitrile as a initiator, to obtain a copolymer having a weight average molecular weight of 10,000. Then after 26 parts of n-butanol was added, half esterifying reaction was done for 5 hours, to obtain the charge controller (A6) of the invention.

Comparative Example CA5

In the same manner as Example A6 except that n-butanol was not added, the charge controller (CA5) for comparison was obtained.

Example A7

649 parts of a mixture of 1alkene of C12 and C14 (Diaren 124, supplied from Mitsubishi Chemical Industries, Ltd.) and 649 parts of maleic anhydride were polymerized in the same manner as Example A6, to obtain a copolymer having a weight average molecular weight of 16,000. Then after 193 parts of stearyl alcohol was added, half esterifying reaction was done for 5 hours, and then to toluene was distilled off, to obtain the charge controller (A7) of the invention.

Comparative Example CA6

In the same manner as Example A7 except that stearyl alcohol was not added, the charge controller (CA6) for comparison was obtained.

Example A8

832 parts of a mixture of 1-alkene of C30-C40 (Diaren 30, supplied from Mitsubishi Chemical Industries, Ltd.) and 168 parts of maleic anhydride were polymerized in the same manner as Example A6, to obtain a copolymer having a weight average molecular weight of 9,000. Then after 15 parts of n-butanol was added, half esterifying reaction was done for 5 hours, and then toluene was distilled off, to obtain the charge controller (A8) of the invention.

According to the result of DSC measurement of the charge controller (A8), a thermal absorbent peak owing to the melting point was observed at 65° C.

Comparative Example CA7

In the autoclave, 351 parts of 1-butene and 649 parts of maleic anhydride were polymerized in the same manner as Example A6, to obtain a copolymer having a weight average molecular weight of 20,000. Then after 59 parts of n-butanol was added, half esterifying reaction was done for 5 hours, and then to toluene was distilled off, to obtain the charge controller (CA7) for comparison.

Example A9

702 parts of a mixture of 1-alkene of C16-C18 (Diaren 168, supplied from Mitsubishi Chemical Industries, Ltd.) and 298 parts of maleic anhydride were polymerized in the same manner as Example A6, to obtain a copolymer having a weight average molecular weight of 14,000. Then after 56 parts of n-butanol was added, half esterifying reaction was done for 5 hours, and then toluene was distilled off, to obtain the charge controller (A9) of the invention.

Example A10

900 parts of styrene, 40 parts of maleic anhydride and 60 parts of butyl acrylate were polymerized for 3 hours in toluene at the boiling point using azobisisobutyronitrile as a initiator, and then toluene was distilled off, to obtain a styrenic polymer(a) having a weight average molecular weight of 16,000.

Under tile presence of 500 parts of the styrenic polymer (a) and in toluene at the boiling point, the graft polymerization was done for 4 hours using 398 parts of stearyl methacrylate and 102 parts of methacrylic acid and under the presence of 13 parts of cumyl hydroperoxide as a initiator and then toluene was distilled off, to obtain the charge controller (A10) of the invention.

Comparative Examples CA8 and CA9

In the same manner as Example A10 except that methacrylic acid was not added, the charge controller (CA8) for comparison was obtained. On the other side, in the same manner as Example A10 except that stearyl methacrylate was not added, the charge controller (CA9) for comparison was obtained.

Example A11

930 parts of styrene, 70 parts of butyl acrylate were polymerized for 4 hours in toluene at the boiling point using azobisisobutyronitrile as a initiator, and then toluene was distilled off, to obtain a styrenic polymer (b) having a weight average molecular weight of 10,000 and hydroxyl value of 19 mg KOH/g.

In MIBK at the boiling point, the styrenic polymer (b) and 417 parts of stearyl alcohol were added to 183 parts of the polyitaconic anhydride(a) and then the half-esterifying and graft-polymerization reaction was done for 5 hours, and then MIBK was distilled off, to obtain the charge controller (A11) of the invention.

According to the result of DSC measurement of the charge controller (A11), a thermal absorbent peak owing to the melting point was observed at 40° C.

Comparative Example CA10

In the same manner as Example A11 except that the half-esterifying reaction was done using 114 parts of butanol instead of 417 parts of stearyl alcohol, the charge controller (CA10) for comparison was obtained.

Example A12

200 parts of styrene was further added to 800 parts of the charge controller (A3) and the graft-polymerization was done for 6 hours in xylene at 180 ° C. using di-tert-butyl peroxide as an initiator, and then xylene was distilled off, to obtain the charge controller (A12) of the invention.

Example A13

500 parts of styrene was further added to 500 parts of the charge controller (A4) and the graft-polymerization was done in the same manner as Example A12, to obtain the charge controller (A13) of the invention.

According to the result of DSC measurement of the charge controller (A13), a thermal absorbent peak owing to the melting point was observed at 39° C.

Example A14

300 parts of the styrenic polymer (b) and 359 parts of stearyl alcohol were added to 341 parts of the copolymer of maleic anhydride/isobutylene (50/50) (Isoban-04, supplied from Kuraray Co. Ltd.) and then the half-esterifying and graft-polymerization reaction was done for 5 hours, to obtain the charge controller (A14) of the invention.

Comparative Example CA11

In the same manner as Example A14 except that the half-esterifying reaction was done using 98 parts of butanol instead of 359 parts of stearyl alcohol, the charge controller (CA11) for comparison was obtained.

Example A15

860 parts of styrene and 140 parts of butyl acrylate were polymerized for 4 hours in toluene at the boiling point under the presence of 15 parts of 2-aminoethyl mercaptan and using 5 parts of azobisisobutylonitrile as initiator, and then toluene was distilled off, to obtain a styrenic polymer (c) having a weight average molecular weight of 20,000 and amine value of 11 mg KOH/g.

In toluene at the boiling point, 767 parts of a mixture of 1-alkene of C20-C28 (Diaren 208, supplied from Mitsubishi Chemical Industries, Ltd.) and 233 parts of maleic anhydride were polymerized using azobisisobutyronitrile as an initiator, to obtain a copolymer having a weight average molecular weight of 10,000. Then 1000 parts of the styrenic polymer (c) and n-butanol were added and the half-esterifying and graft-polymerization reaction was done for 5 hours, and then toluene was distilled off, to obtain the charge controller (A15) of the invention.

Example A16

649 parts of a mixture of 1alkene of C12 and C14 (Diaren 124, supplied from Mitsubishi Chemical Industries, Ltd.) and 351 parts of maleic anhydride were polymerized in the same manner as Example A15, to obtain a copolymer having a weight average molecular weight of 16,000. Then 193 parts of stearyl alcohol and 500 parts of the styrenic polymer (b) were added and the half-esterifying and graft-polymerization reaction was done for 5 hours, and then toluene was distilled off, to obtain the charge controller (A16) of the invention.

Example A17

832 parts of a mixture of 1-alkene of C30-C40 (Diaren 30, supplied from Mitsubishi Chemical Industries, Ltd.) and 163 parts of maleic anhydride were polymerized in the same manner as Example A15, to obtain a copolymer having a weight average molecular weight of 9,000. Then 500 parts of the styrenic polymer(b) and 15 parts of n-butanol were added and the half-esterifying reaction was done for 10 hours, and then toluene was distilled off, to obtain the charge controller (A17) of the invention.

According to the result of DSC measurement of the charge controller (A17), a thermal absorbent peak owing to the melting point was observed at 64° C.

Comparative Example CA12

In the same manner as Example A17 except that 96 parts of 1-butene was used instead of 832 parts of a mixture of 1-alkene of C30-C40, the half-esterifying reaction was done, the charge controller (CA12) for comparison was obtained.

Example A18

702 parts of a mixture of 1-alkene of C16-C18 (Diaren 168, supplied from Mitsubishi Chemical Industries, Ltd.) and 298 parts of maleic anhydride were polymerized in the same manner as Example A15, to obtain a copolymer having a weight average molecular weight of 14,000. Then 500 parts of the styrenic polymer (b) and 82 parts of stearyl alcohol were added and the half-esterifying and graft-polymerization reaction was done for 10 hours, and then toluene was distilled off, to obtain the charge controller (A18) of the invention.

Example A 19

The condensation polymerization of 740 parts of bisphenol A propylene oxide 2 mol. adduct and 330 parts of terephthalic acid were done at 230° C. using 2 parts of dibutyltin oxide as a catalyst, and then 24 parts of methacryloyl isocyanate was reacted in toluene, to obtain the polyester polymer(a) having weight average molecular weight of 8,000.

Under the presence of 500 parts of the polyester (a) and in toluene at the boiling point, 398 parts of stearyl methacrylate and 102 parts of methacrylic acid were polymerized using 30 parts of azobisisobutylonitrile as an initiator, and then toluene was distilled off, to obtain the charge controller (A19) of the invention having a grafted chain.

Comparative Examples CA13 and CA14

In the same manner as Example A19 except that methacrylic acid was not added, the charge controller (CA13) for comparison was obtained. On the other hand, in the same manner as Example A19 except that stearyl methacrylate was not added, the charge controller (CA14) for comparison was obtained.

Example A20

Condensation polymerization of 723 parts of bisphenol A propylene oxide 2 mol. adduct and 348 parts of isophthalic acid were done at 230° C. using 2 parts of dibutyltin oxide as a catalyst, to obtain the polyester (b) having a weight average molecular weight of 6,000 and OH value of 20 mg KOH/g.

In MIBK at the boiling point, 400 parts of the polyester (b) and 413 parts of stearyl alcohol were added to 187 parts of polyitaconic anhydride(a), and the half-esterifying and graft-polymerization reaction was done for 5 hours, to obtain the charge controller (A20) of the invention.

According to the result of DSC measurement of the charge controller (A20), a thermal absorbent peak owing to the melting point was observed at 40° C.

Comparative Example CA15

In the same manner as Example A20 except that 113 parts of butanol was used instead of 413 parts of stearyl alcohol, the charge controller (CA15) for comparison was obtained.

Example A21

Under the presence of 200 parts of the polyester (a) and in MEK at the boiling point, 784 parts of monolauryl itaconate, 8 parts of acrylic acid and 8 parts of methyl acrylate were polymerized for 20 hours using 10 parts of azobiscyclohexanecarbonitrile as an initiator, and then MEK was distilled off, to obtain the charge controller (A21) of the invention having a grafted chain.

Example A22

Under the presence of 500 parts of the polyester (a), 494 parts of monostearyl itaconate, 3 parts of acrylic acid and 3 parts of butyl acrylate were polymerized in the same manner as Example A21, to obtain the charge controller (A21) having a grafted chain of the invention.

Example A23

300 parts of the polyester polymer (b) and 359 parts of stearyl alcohol were added to 341 parts of the copolymer of maleic anhydride/isobutylene (50/50) (Isoban-04, supplied from Kuraray Co. Ltd.) and reacted in the same manner as Example A14, to obtain the charge controller(A23) of the invention.

Comparative Example CA16

In the same manner as Example A23 except that 98 parts of butanol was used instead of 359 parts of stearyl alcohol, the charge controller (CA16) for comparison was obtained.

Example A24

Condensation polymerization of 740 parts of bisphenol A propylene oxide 2 mol. adduct and 330 parts of terephthalic acid were done at 230° C. using 2 parts of dibutyltinoxide as a catalyst, to obtain the polyester(c) having a weight average molecular weight of 8,000.

In toluene at the boiling point, 380 parts of a mixture of 1-alkene of C20-C28 (Diaren 208, supplied from Mitsubishi Chemical Industries, Ltd.) and 115 parts of maleic anhydride were polymerized using 100 parts of azobisisobutyronitrile as an initiator, to obtain a copolymer having a weight average molecular weight of 10,000. Then 495 parts of the polyester (c) and 10 parts of n-butanol was added and the half-esterifying and graft-polymerization reaction was done, and then toluene was distilled off, to obtain the charge controller (A24) of the invention.

Example A25

389 parts of a mixture of 1-alkene of C12 and C14 (Diaren 124, supplied from Mitsubishi Chemical Industries, Ltd.) and 211 parts of maleic anhydride were polymerized in the same manner as Example A24, to obtain a copolymer having a weight average molecular weight of 16,000. Then 116 parts of stearyl alcohol and 400 parts of the polyester (b) was added and the half-esterifying and graft-polymerization reaction was done, and then toluene was distilled off, to obtain the charge controller (A25) of the invention.

Example A26

413 parts of a mixture of 1-alkene of C30-C40 (Diaren 30, supplied from Mitsubishi Chemical Industries, Ltd.) and 83 parts of maleic anhydride were polymerized in the same manner as Example A24, to obtain a copolymer having a weight average molecular weight of 9,000. Then 496 parts of the polyester (b) and 8 parts of n-butanol was added and the half-esterifying and graft-polymerization reaction was done, and then toluene was distilled off, to obtain the charge controller (A26) of the invention.

Comparative Example CA17

In the same manner as Example A26 except that 48 parts of 1-butene was used instead of 413 parts of a mixture of 1-alkene of C30-C40, the charge controller (CA17) for comparison was obtained.

Example A27

337 parts of a mixture of 1-alkene of C16-C18 (Diaren 168, supplied from Mitsubishi Chemical Industries, Ltd.) and 143 parts of maleic anhydride were polymerized in the same manner as Example A24, to obtain a copolymer having a weight average molecular weight of 14,000. Then 480 parts of the polyester (b) and 40 parts of stearyl alcohol was added and the half-esterifying and graft-polymerization reaction was done for 10 hours, and then toluene was distilled off, to obtain the charge controller (A27) of the invention.

Example B1

30 parts of the charge controller(A2) and 1,000 parts of a styrenic toner binder (Himer UNI-3000, supplied from Sanyo Chemical Industries, Ltd.) were solved and mixed in toluene. On removing toluene, the toner binder composition (B1) of the invention was obtained.

Example B2

In the same manner as Example B1 except that 25 parts of the charge controller(A9) was used instead of 30 parts of the charge controller (A2), the toner binder composition (B2) of the invention was obtained.

Example B3

In the same manner as Example B1 except that 40 parts of the charge controller (A11) was used instead of 30 parts of the charge controller(A2), the toner binder composition (B3) of the invention was obtained.

Example B4

In the same manner as Example B1 except that 40 parts of the charge controller (A18) was used instead of 30 parts of the charge controller (A2), the toner binder composition(B4) of the invention was obtained.

Example B5

Condensation polymerization of 417 parts of bisphenol A propylene oxide 2 mol. adduct, 341 parts of bisphenol A ethylene oxide 2 mol. adduct and 310 parts of terephthalic acid were done using 2 parts of dibutyltinoxide as a catalyst, to obtain the polyester toner binder (a) having a weight average molecular weight of 8,000.

40 parts of the charge controller (A20) and 1000 parts of the toner binder (a) were mixed in the same manner as Example B1, to obtain the toner binder composition (B5) of the invention.

Example B6

50 parts of the charge controller (A27) and 1000 parts of the toner binder (a) were mixed in the same manner as Example B1, to obtain the toner binder composition (B6) of the invention.

Examples T1-T12 and Comparative Examples CT1-CT7

The toner was prepared using, as components, each charge controller (parts) as shown in Table 1, 1000 parts of styrenic toner binder (Himer UNI-3900, supplied from Sanyo Chemical Industries, Ltd.), 80 parts of carbon black (MA-100, supplied from Mitsubishi Chemical Industries, Ltd.) and 40 parts of low molecular weight polypropylene (Viscol 660P, supplied from Sanyo Chemical Industries, Ltd.) and according to the following process:

In the first place, these components were preliminarily mixed with Henschel mixer (FM1OB, supplied from Mitsuimiike Kakouki, Ltd.) and then kneaded with a twin screw extruder(PCM-30, supplied from Ikegai, Ltd.) Each of the resulted products was further pulverized finely with a supersonic jet mill Labo Jet (supplied from Japan Pneumatic Industries, Ltd.) and classified afterwards with a air stream classifier (MDS-I, supplied from Japan Pneumatic Industries, Ltd.) to obtain each powdered product having a particle size of 5–20 μm, namely the toner (T1)–(T12) of the invention and the toner (CT1)–(CT7) for comparison.

The properties of each toner are shown in Table 1 and the evaluation results are shown in Table 2.

Example T13

Synthesis of Compatibilizer:

500 parts of stearyl methacrylate was polymerized in xylene at the boiling point using 20 parts of azobisisobutylonitrile, to obtain a polymer. Under the presence of this polymer and 5 parts of di-tert-butyl peroxide as an initiator, graft-polymerization was done at 180° C. using 500 parts of styrene, to obtain a compatibilizer (a).

Preparation of Toner and Evaluation:

In the same manner as Example T1 except that 6 parts of compatibilizer (a) was additionally used, the toner (T13) was prepared. The properties of the toner are shown in Table 1 and the evaluation results are shown in Table 2. t,0540 t,0550

<Evaluation Methods>

1) Preparation of Developers:

The developers were prepared by mixing 1 part of the toner and 24 parts of the ferrite carrier for electrophotography (F-150, supplied from Powdertec, Ltd.).

2) Measurement of the Saturated Charge (Charge):

The moisture of the above-mentioned developers were controlled at 23° C. under 50% R.H. for not less than 8 hours, and then each sample was stirred with a terbler shaker mixer using a frictional force at 50 r.p.m. for each period of 1, 3, 7, 20, 60 and 120 min., and measured the electrostatic charge in each period. The charge at the period when the growth of the electrostatic charge was not observed was defined as the saturated charge.

The equipment used for this measurement: Blow off method charge measuring machine (supplied from Toshiba Chemical Co., Ltd.)

3) Evaluation Criteria of the Charge

In accordance with the above-mentioned results of the amount of the charge measured, the ranking of the charging rate was determined based on the following criteria:

A: The stirring period using a frictional force is less than 20 min. when the charge reaches upto 80% of the saturated charge.

B: The stirring period using a frictional force is 20–60 min. when the charge reaches upto 80% of the saturated charge.

C: The stirring period using a frictional force is more than 60 min. when the charge reaches upto 80% of the saturated charge.

4) Measurement of Dependence to the Circumstances

After the moisture of the above-mentioned developers was controlled in high temperature and high humidity and in low temperature and low humidity, the electrostatic charge of these samples was measured. t,0570

Evaluation Criteria:

The change of the amount of the electrostatic charge in low temperature and low humidity and in high temperature and high humidity is —A: small, B: medium, C: large.

5) Copying Test

A continuous copying test of the above-mentioned developers was done with a copying machine for evaluation.

Copying machine for evaluation:

An negatively charged electrophotographic copying machine using selenium sensitized material. The number of papers available for a continuous copying is 20,000.

Evaluation Criteria:

A: The copied image on the paper is good after the 20,000 sheets of continuous copying.

B. The deterioration of the copied image on the paper is observed after the 20,000 sheets of continuous copying.

C: The copied image is poor from the beginning of copying.

Examples T14-T15 and Comparative Examples CT8-CT13

The toners were prepared in the same manner as Example T1 using the recipes as shown in Table 3, to obtain the toners (T14)–T25) of the invention and the Toners (CT8)–(CT13) for comparison. The properties of these toners are shown in Table 3 and the evaluation results are in Table 4. t,0580 t,0590

<Evaluation Methods>

The following items 1)–5) were done in the same manner as Example T1. On the other hand, the distribution of the charge amount was measured by the following method of 6):

1) Preparation of Developers

2) Measurement of Saturated Amount of the Charge (Amount of the Charge)

3) Evaluation Standard of Start Up of the Charge

4) Measurement of Dependence to the Circumstances

5) Copying Test

6) Measurement of Charge Distribution

The moisture of the above-mentioned developers were controlled at 23° C. under 50% R. H. for not less than 8 hours, and the test samples were mixed with terbler shaker mixer using a frictional force at 50 r.p.m. for 20 min., and then the charge distribution was measured. Equipment: The charge distribution of the particle testing machine (EST-1, supplied from Hosokawa Micron, Co., Ltd.)

Evaluation Criteria:

A: The charge amount distribution is narrow.

B: The charge amount distribution is medium.

C: The charge amount distribution is wide. Examples T26–T37 and Comparative Examples CT14–CT19

<Preparation of Toners>

Condensation polymerization was done using 751 parts of bisphenol A propylene oxide 2 mol. adduct and 104 parts of trimellitic anhydride and 2 parts of dibutyltinoxide as a catalyst, to obtain the polyester toner binder (b) having a softening point of 127° C.

<Preparation of Toners and Evaluation>

The Preparation of toners were done in the same manner as Example T1 except that the polyester toner binder (b) was used instead of the styrenic toner binder, and using the recipes as shown in Table 5, to obtain the toners (T26)–(T37) of the invention and the Toners (CT14)–(CT19) for comparison. The properties of these toners are shown in Table 5 and the evaluation results are in Table 6.

Examples T38 and T39

The Preparation of toners were done in the same manner as Example T1 using 1000 parts of the polyester toner binder (a), 400 parts of the charge controller (A20) and 50 parts of the colorant (Firstgenmazenta R-11, supplied from Dainippon Ink Industries, Ltd.), to obtain the toners (T38) of the invention. The evaluation results are in Table 6. t,0620 t,0630

<Evaluation Methods>

The following items 1)–6) were done in the same manner as Example T14. On the other side, the transparency was measured by the following method of 7):

1) Preparation of Developers
2) Measurement of Saturated Amount of the Charge (Amount of the Charge)
3) Evaluation Standard of Start Up of the Charge
4) Measurement of Dependence to the Circumstances
5) Copying Test
6) Measurement of Distribution of Charge Amount
7) Evaluation of Transparency The toner binders and the charge controllers were kneaded without the addition of the colorants and the low molecular weight polypropylene, and then the kneaded samples were molded into cylindrical pellets of about 5 mm with melt indexer and the transparency of the pellets were visually evaluated.

Evaluation Criteria

A: Transparent

B: Slightly cloudy

C: Cloudy in white color

Examples T40-T50

The toners were prepared in the same manner as Example T1 using the toner binder compositions (B1)–(B6) and based on the recipes as shown in Table 7. The evaluation results are shown in Table 8. t,0650 t,0651

The charge controller, the toner binder composition and the electrophotographic toner according to the present invention, having effects as follows, are useful for toners in electrophotography, electrostatic recording paper and the like.

1) As said charge controller does not contain heavy metal, they are excellent in safety.
2. As said charge controller hardly causes coloring, the color tone of the toner is excellent in applying color toner.
3. As said charge controller has excellent transparency, the color tone of tile toner is excellent in applying color toner.
4. As the dispersing property of said charge controller is excellent, the toner prepared thereof has a sharp charge distribution.
5. As said charge controller can hold a high amount of electrostatic charge, a toner containing a suitable amount of charge can be prepared only by using a small amount of said charge controller.

What is claimed is:

1. An electrophotographic toner containing a toner binder, a colorant and a charge controller comprising an acid group-containing polymer, wherein:

1) at least a portion of said binder constitutes a continuous phase;
2) at least a portion of the charge controller constitutes discontinuous domains;
3) the charge controller comprises a polymer moiety (α) forming the discontinuous domain, said moiety (α) having a solubility parameter the same or lower by at most 2.5 than that of the continuous phase-forming binder (β);
4) said moiety (α) has an acid number of 50–400, and at least 3% of the acid group being a free acid group;
5) the acid group-containing polymer is a polymer or copolymer comprising units of at least one acid group-containing monomer selected from the group consisting of a carboxylic acid group-containing monomer, a sulfonic acid group-containing monomer, a phosphoric acid group-containing monomer and a boric acid group-containing monomer; and
6) said binder comprises at least one polymer selected from the group consisting of a polymer or copolymer of at least one monomer selected from the group consisting of a styrenic monomer and an acrylic or methacrylic monomer, a polyester, an epoxy resin, a polyolefin and a polyurethane.

2. The toner according to claim 1 wherein said domains have an average particle size of 0.01–0.8 μm.

3. The toner according to claim 1, wherein said moiety (α) has a melting point of 25°–100° C. or has a glass transition temperature of 25°–100° C.

4. The toner according to claim 1, which further comprises a polymeric compatibilizer (γ) having compatibility with both (α) and (β).

5. The toner according to claim 1, wherein the acid group-containing polymer is a polymer (A) having an alkyl group containing 6–50 carbon atoms and a carboxyl group.

6. The toner according to claim 5, wherein said polymer (A) is selected from the group consisting of:

(A1) a polymer or copolymer containing at least 5 mol. % of monomer units of
(1) a monoalkyl ester of an α,β-ethylenically unsaturated dicarboxylic acid, containing 6–50 carbon atoms in the alkyl group; and (A2) a copolymer containing 5–75 mol. % of monomer units of
(2) a carboxylic group-containing α,β-ethylenically unsaturated monomer, selected from the group consisting of:
2-1) a monoester of an α,β-ethylenically unsaturated dicarboxylic acid, and
2-2) a monoamide of an α,β-ethylenically unsaturated dicarboxylic acid,
and 6–80 mol % of monomer units of
(3) an ethylenically unsaturated monomer having an alkyl group containing 6–60 carbon atoms.

7. The toner according to claim 6, wherein (1) is a monoalkyl itaconate.

8. The toner according to claim 6, wherein (3) is selected from the group consisting of:

(3-1) an ethylenically unsaturated alkyl ester monomer having an alkyl group containing 6–60 carbon atoms;

(3-2) α-olefin containing 8–52 carbon atoms; and (3-3) an alkyl vinyl ether having an alkyl group containing 6–50 carbon atoms.

9. A charge controller which comprises a copolymer (AB) comprising:

a polymer moiety (a) having an alkyl group containing 6–50 carbon atoms and a carboxyl group, said moiety (a) being selected from the group consisting of:

(a1) a moiety of a polymer or a copolymer containing at least 5 mol.

of monomer units of (1) a monoalkyl ester of an α, β-ethylenically unsaturated dicarboxylic acid, containing 6–50 carbon atoms in the alkyl group, and (a2) a moiety of a copolymer containing 5–75 mol. % of monomer units of (2) a carboxylic group containing α, β-ethylenically unsaturated monomer.

and 6–80 mol. % of monomer units of (3) an ethylenically unsaturated monomer having an alkyl group consisting of 6–50 carbon atoms; and a polymer moiety (b), bound graft-wise or block-wise thereto, said moiety (b) being selected from group consisting of (b1) a styrenic polymer moiety, and (b2) a polyester moiety.

10. The charge controller according to claim 9, which comprises:

1) at least 1% by weight of said copolymer(AB);

0–99% by weight of a polymer (AA) having an alkyl group containing 6–50 carbon atoms and a carboxyl group and free from said moiety (b), said polymer (AA) being selected from the group consisting of (A1) a polymer or copolymer containing at least 5 mol, % of monomer units of (1) a monoalkyl ester of an α, β-ethylenically unsaturated dicarboxylic acid, containing 6–50 carbon atoms in the alkyl group, and (A2) a copolymer containing 5–75 mol. % of monomer units of (2) a carboxylic group-containing α, β-ethylenically unsaturated monomer, and 6–80 mol. % of monomer units of (3) an ethylenically unsaturated monomer having an alkyl group containing 6–50 carbon atoms; and 3) 0–90% by weight of a polymer (B) selected from the group consisting of a styrenic polymer (B1) and a polyester (B2).

11. The charge controller according to claim 10, wherein (b) is a moiety of a styrenic polymer containing at least 50 mol. % of styrene units and (B) is a styrenic polymer containing at least 50 mol. % of styrene units.

12. The charge controller according to claim 10, wherein (b) is a moiety of a polyester of polycarboxylic acid with a polyol comprising an oxyalkylene ether of a bisphenol.

13. The charge controller according to claim 10, wherein the total content of (a) and (AA) is 10–99% by weight and the total content of (b) and (B) is 1–90% by weight.

14. A toner binder composition comprising the charge controller according to claim 9 and a toner binder comprising at least one polymer selected from the group consisting of: a polymer or copolymer of at least one monomer selected from the group consisting of a styrenic monomer and an acrylic or methacrylic monomer; a polyester; an epoxy resin; a polyolefin and a polyurethane.

15. A toner binder composition, which comprises the charge controller according to claim 11, and a toner binder comprising a styrenic polymer.

16. A toner binder composition, which comprises the charge controller according to claim 12, and a toner binder comprising a polyester.

17. An electrophotographic toner which comprises a toner binder, a colorant and a charge controller according to claim 9.

18. An electrophotographic toner, which comprises a toner binder, a colorant and a charge controller comprising a polymer (A) having an alkyl group containing 6–50 carbon atoms and a carboxyl group, said polymer (a) being selected from the group consisting of:

(A1) a polymer or copolymer containing at least 5 mol. % of monomer units of (1) a monoalkyl ester of an α,β-ethylenically unsaturated dicarboxylic acid, containing 6–50 carbon atoms in the alkyl group; and (A2) a copolymer containing 5–75 mol. % of monomer units of (2) a carboxylic group-containing α,β-ethylenically unsaturated monomer, selected from the group consisting of:

(2- 1) a monoester of an α,β-ethylenically unsaturated dicarboxylic acid, and (2-2) a monoamide of an α,β-ethylenically unsaturated dicarboxylic acid, and 6–80 mol. % of monomer units of (3) an ethylenically unsaturated monomer having an alkyl group containing 6–50 carbon atoms; and further comprises a polymeric compatibilizer (γ) having compatibility with both the polymer (A) and the toner binder.

* * * * *